US007628269B2

(12) United States Patent
O'Hara et al.

(10) Patent No.: US 7,628,269 B2
(45) Date of Patent: Dec. 8, 2009

(54) COUNTDOWN TIMER CONTACT LENS CASE

(75) Inventors: John O'Hara, 2601 Warson Rd., St. Louis, MO (US) 63124; Christopher L. Peterson, Chippewa Falls, WI (US); Micah L. Maraia, Menomonie, WI (US); Robert G. Fehr, Colfax, WI (US); Martin W. Stone, Arden Hills, MN (US); Thomas H. Van Hoozer, Jr., Kansas City, MO (US)

(73) Assignee: John O'Hara, St. Louis, MI (US)

( * ) Notice: Subject to any disclaimer, the term of this patent is extended or adjusted under 35 U.S.C. 154(b) by 489 days.

(21) Appl. No.: 11/627,801

(22) Filed: Jan. 26, 2007

(65) Prior Publication Data

US 2008/0179200 A1 Jul. 31, 2008

(51) Int. Cl.
*A45C 11/04* (2006.01)

(52) U.S. Cl. ..... 206/5.1; 206/459.1; 116/308; 368/10

(58) Field of Classification Search ..... 206/5.1, 206/459.1; 116/307, 308, 316, 318, 321; 134/901; 368/10, 107, 278; 53/431, 467
See application file for complete search history.

(56) References Cited

U.S. PATENT DOCUMENTS

| | | | | |
|---|---|---|---|---|
| 4,909,382 | A | 3/1990 | Cuppari | |
| 5,280,834 | A | 1/1994 | Berkley | |
| D354,070 | S | 1/1995 | Chen | |
| 5,452,792 | A | 9/1995 | Zautke et al. | |
| D393,721 | S | 4/1998 | Okada | |
| 6,038,997 | A | 3/2000 | Madden | |
| 6,382,409 | B1 * | 5/2002 | Scala | 206/5.1 |
| D474,886 | S | 5/2003 | Fleming | |
| 7,042,805 | B1 * | 5/2006 | Kallman | 368/10 |
| D534,422 | S | 1/2007 | Hallberg | |
| 7,397,347 | B1 * | 7/2008 | Joyce | 206/5.1 |
| 7,500,750 | B2 * | 3/2009 | Sabeta | 351/177 |
| 2007/0000792 | A1 | 1/2007 | Newman et al. | |
| 2007/0284263 | A1 * | 12/2007 | Giardina et al. | 206/5.1 |
| 2008/0205197 | A1 * | 8/2008 | Martin | 368/10 |

OTHER PUBLICATIONS

U.S. Appl. No. 60/812,516, filed Jun. 8, 2006, Giardina et al.

* cited by examiner

*Primary Examiner*—Luan K Bui
(74) *Attorney, Agent, or Firm*—Hovey Williams LLP

(57) ABSTRACT

A countdown timer contact lens case is provided for removably receiving a receptacle and providing independent timing functions for displaying the useful remaining life of a contact lens and for the receptacle for receiving the contact lens when not worn. The countdown timer contact lens case includes a receptacle carried by a main body. The main body includes a timing circuit and a display with first and second indicators corresponding to the respective remaining time for desired use of the lens and for the receptacle. The timer for the lens displays a maximum value which is less than the displayed maximum value of the timer for the receptacle. The timer corresponding to each of the lens and the receptacle can be independent set and reset, and a warning feature is provided to signal the user when the corresponding displayed lens or receptacle value diminishes below a minimum, or decreases to zero.

15 Claims, 4 Drawing Sheets

COUNTDOWN TIMER CONTACT LENS CASE

BACKGROUND OF THE INVENTION

1. Field of the Invention

The present invention concerns a contact lens case which is provided with a resettable timer for allowing the user to monitor the remaining useful period available for the lenses. More particularly, the contact lens case hereof enables the user to also monitor the remaining useful period for the lens receptacle before replacement of the receptacle is recommended.

2. Description of the Prior Art

Contact lenses are well known optical devices used instead of conventional eyeglasses to improve the vision of the wearer and are placed directly on the wearer's eye. To avoid drying of the eye and resulting discomfort arising from wearing of the contact lens for extended periods, particularly during sleep, it is desirable that the contact lens be removed from the eye periodically. During the periods of non-use, the contact lenses need to be stored in a case to facilitate locating them for reuse, avoiding contamination, and to permit application of antibacterial solutions to the contact lenses. As contact lens technology evolved, the contact lenses were made of more advanced materials to make them less expensive and lighter in weight. As a consequence, these improved contact lenses are typically of a synthetic resin material which are designed to be disposed and replaced after a recommended useful life period.

One reason that the lenses are recommended to be discarded after use over the aforementioned useful life period, typically about one month, is that the synthetic resin of the replaceable contact lenses may accumulate microscopic particles or organisms such as bacteria. While disinfectant solutions may be applied to rinse and limit the effect of these accumulations, the risk of infection or injury to the eye of the wearer increases over time, thus necessitating the replacement of the contact lens at the end of the recommended useful life period.

Various articles have been developed for showing the elapsed period of use for contact lenses and which provide for storage of the contact lenses. These articles are shown in U.S. Pat. Nos. 4,909,382, 5,452,792, 6,038,997, 6,382,409 and 7,042,805, the disclosures of which are incorporated herein by reference. While these various devices are beneficial, they generally require the user to remember and/or recalibrate the device to indicate the useful life of the lenses after replacement of the lenses.

It has also been learned that the storage of the contact lens in the case may result in similar accumulations in the storage case itself. That is to say, some of the microscopic materials and organisms which may be deposited on the contact lenses may then be transferred to and retained by the contact lens case.

SUMMARY OF THE INVENTION

The present invention provides a contact lens case which largely overcomes the disadvantages of the prior contact lens cases. Moreover, it addresses the issue of providing an indicator not only for the remaining suggested useful life of the lenses, but allows for presentation of a separate and different period for receptacles which receives the lenses. Preferably, the receptacles are readily detachable from a main body which includes a timer unit. The timer unit includes a countdown timing circuit and display feature which is initially set by the user within a predetermined time range corresponding to the suggested duration of the lenses and which counts down the time to a zero time indicator corresponding to the suggested date for lens replacement. Of particular benefit is a feature of the countdown timing circuit and display in the present invention providing for first and second, discrete countdown timing elements wherein a different timing range shows the remaining useful life of both the lens and the receptacle for the lens. The useful life of the receptacle, typically of a greater duration than the lens, can thus be set and displayed in proximity to the display showing the remaining useful life of the lens. This second countdown timing element feature provides the user with information indicating the remaining suggested time for use of the receptacle, and upon the presentation of a zero time indicator for the receptacle, the receptacle should be detached from the main body and replaced.

Broadly speaking, the present invention includes a main body member adapted to receive a complementally configured receptacle or receptacles sized for receiving a contact lens of a human wearer therein. The receptacle is provided with removable covers for mounting over respective lens receiving cavities of the receptacle in covering relationship. The main body is configured complemental to the receptacle whereby removing the covers by threading does not cause the receptacle to rotate or pivot within the main body. The main body includes a timing circuit with a timing processing member, such as an integrated circuit board, which is electrically coupled to a power source, to respective reset switches, and to respective timing displays. The timing displays are discrete and preferably display discrete numbers corresponding to the remaining suggested useful life of the lenses and for the receptacle. The timing circuit is operatively coupled to the respective reset switches mounted to the main body such that the user initially selects a duration for the lenses and/or the receptacle or receptacles if separate receptacles are provided for individual members, and then may observe the display as the timing circuit counts down to show the amount of time remaining for use of the respective lenses or receptacle.

In preferred embodiments, the main body is provided to receive a receptacle or receptacles without the need for any tools. The main body may be configured either to receive conventional receptacles currently available, or configured to receive and mount specialized contact lens receptacles. Most preferably, the reset switches are positioned on the main body in a position remote from an outer perimeter of the main body, so as to minimize unintended resetting of the timing values. It is preferred that the timing circuit be provided with an integrated circuit programmed to operate in two different value ranges, such that upon resetting, the value of the display for the case may have a higher range than is possible when resetting the value for the lenses. The countdown contact lens case hereof may be configured in different embodiments, such as a larger embodiment having a display extending forwardly of the lens receptacle, or a more linear arrangement with the display positioned generally intermediate and along a line extending between the respective caps for the lenses. In addition, the main body may include a slot for removably receiving an insulating member to be operatively positioned between the electrical power source, such as a battery, and the integrated circuit of the timing device, so as to conserve power during extended periods of storage.

These and other advantages will be readily appreciated by those skilled in the art with reference to the detailed description of the preferred embodiments and the drawings thereof.

DESCRIPTION OF THE PREFERRED EMBODIMENT

Figure 2:
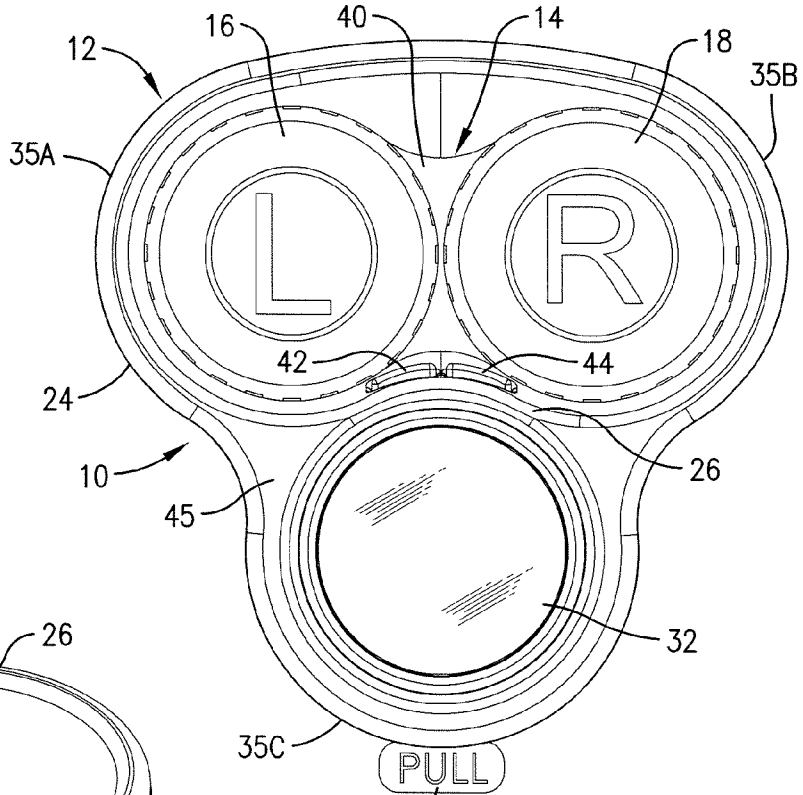
FIG. 2 is a top plan view thereof, showing the position of the reset switches interior to the outer perimeter of the main body.
Figure 1:
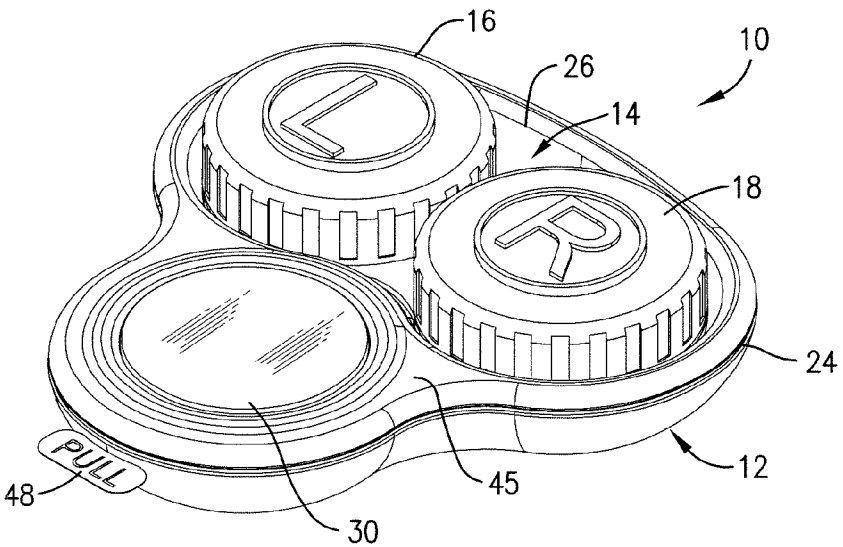
FIG. 1 is a top right front perspective view of a first embodiment of the contact lens case hereof, including both the main body having a timer display which mounts a contact lens receptacle with two covers received in a complementally configure recess, the main body having an insulating member extending forwardly.
Figure 3:
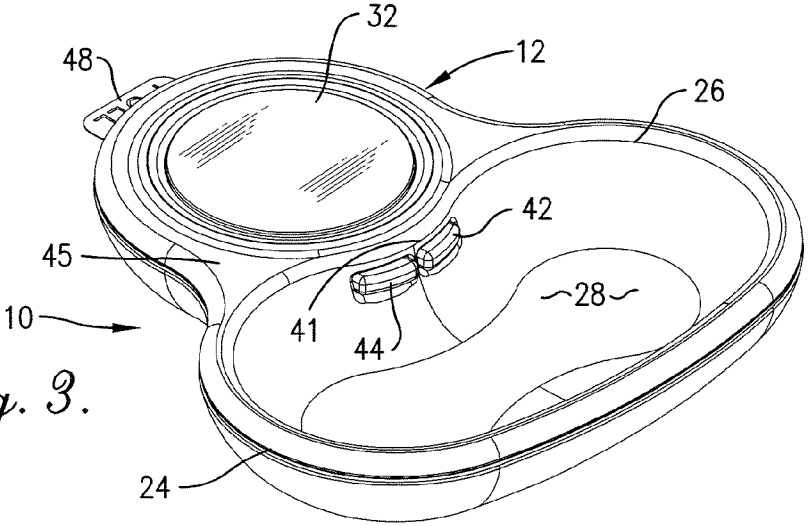
FIG. 3 is a top right rear perspective view thereof, with the receptacle removed to show the recess in the main body and the reset switches.
Figure 4:
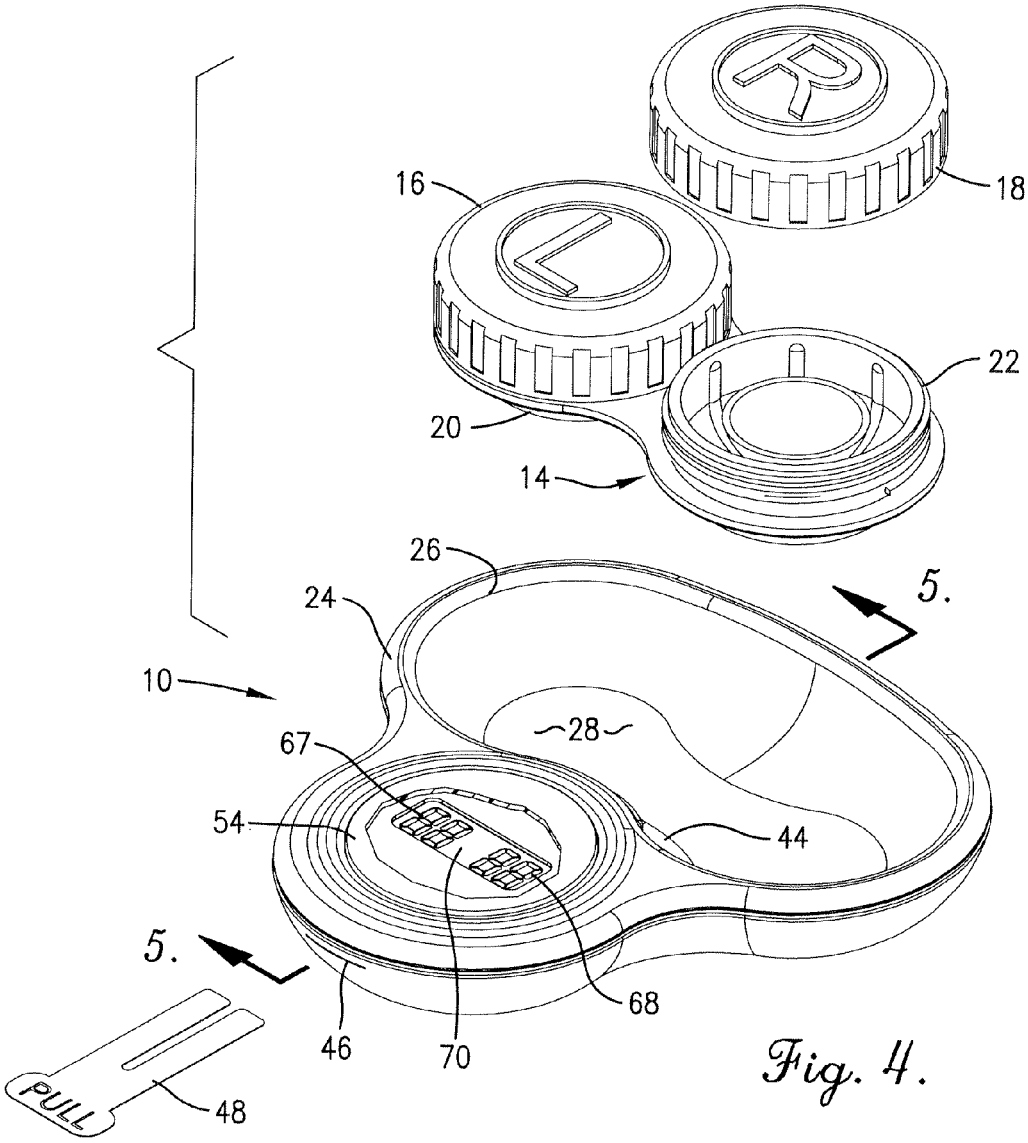
FIG. 4 is an exploded view in perspective thereof, showing one cover the receptacle removed and the insulating member removed to activate the display with a portion of the display cover broken away to show the display images prior to activation.
Figure 5:
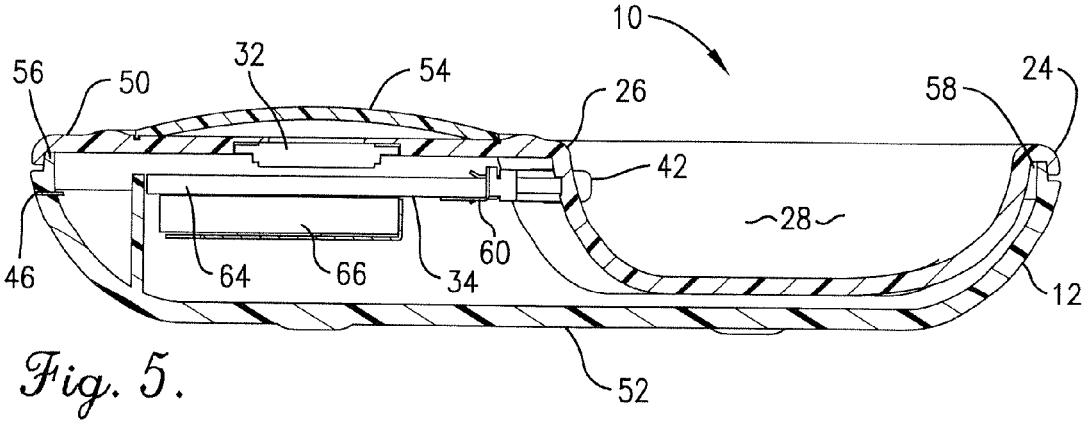
FIG. 5 is a vertical cross-sectional view thereof, taken along line 5-5 of FIG. 4 to show a battery, the timing circuit, the display, one of the reset switches operatively coupled to the timing circuit, and the display cover.
Figure 6:
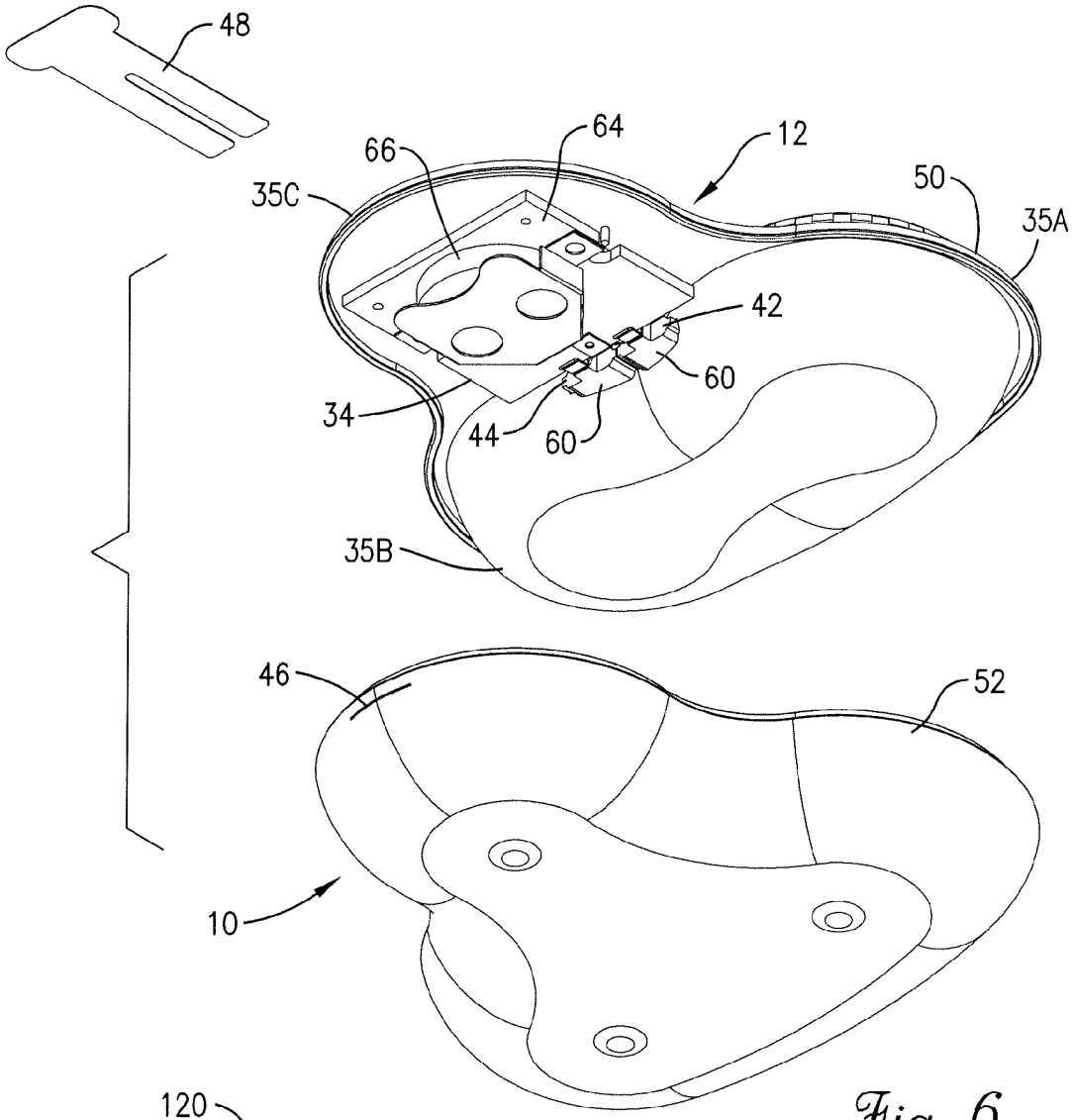
FIG. 6 is a right bottom exploded view in perspective thereof, showing the main body separated into a base member and an operating member housing the timing circuit and display and adapted to receive the receptacle.

Referring now to FIGS. 1 and 2 of the drawings, a first embodiment of the countdown timer contact lens case 10 of the present invention broadly includes a main body 12 and a receptacle 14 which includes removable left (L) and right (R) caps 16 and 18 for corresponding left and right lens-receiving chambers 20 and 22. The main body 12 includes a perimeter rim 24 and an inner rim 26 surrounding a receptacle-receiving recess 28, as shown in FIG. 3. The main body 12 further includes a countdown timer 30 which includes a display 32 and a timing circuit 34 as shown in FIG. 5.

In greater detail, the main body 12 is configured in a three-lobed shape (lobes 35A, 35B and 35C) to removably receive the receptacle 14. As shown in FIGS. 1-4, the recess 28 is configured so as to be complemental in shape to the receptacle 14. For example, the recess 28 as shown in FIGS. 1-5 is configured between lobes 35A and 35B so as to removably receive a receptacle 14. While a number of such receptacles are mountable in the recess 28, one such receptacle is an Alcon Opti-Free contact lens case by Alcon Labs. which includes respective left and right chambers 20 and 22 connected by bridge 40 and which threadably mount caps 16 and 18. The recess 28 is defined by inner rim 26 so as to inhibit the receptacle from moving outside the recess 28 when the caps 16 and 18 are threaded onto the chambers 36 and 38 or removed therefrom. Thus, the recess 28 is arcuate in part to conform to the shape of the receptacle, with a waist 41 which narrows the recess 28 and generally corresponds to the edge configuration of the bridge 40 to facilitate nesting of the receptacle 14 within the recess.

The inner rim 26 also mounts thereon first and second reset switches 42 and 44 which are operatively connected to the timing circuit 34. The first reset switch 42 functions as a lens timer reset switch and the second reset switch 44 functions as a receptacle timer reset switch. Both the reset switches 42 and 44 are positioned remote from both the upper surface 45 of the main body 12, remote from the perimeter rim 24 and on the inner rim 26 as illustrated in FIGS. 2 and 3 to lessen the likelihood that the reset switches may be unintentionally actuated. The first and second reset switches are positioned side-by-side, and positioned on the inner rim 26 adjacent the display 32. Thus, when a user removes the caps 16 and 18, the users fingers and thumb will most likely be remote from the reset switches 42 and 44 to further limit unintended actuation. As seen in FIGS. 2 and 3, the first and second reset switches 42 and 44 are positioned to be intermediate the caps 16 and 18 and the display 32.

The main body 12 also includes a slot 46 which is positioned on third lobe 35C and sized to receive a removable insulating member 48. The insulating member 48 is of synthetic resin or other material which is not electrically conductive to preserve the battery life of the timing circuit when inserted into the slot 46, but upon removal, actuates the timing circuit 34.

FIG. 5 is a cross-sectional view of the main body 12 with the insulating member 48 removed. As may be seen, the main body 12 may have an upper section 50 and a lower section 52, with a transparent display cover 54 fitted to the upper section 50. The two sections 50 and 52 are assembled by receipt of a flange 56 in one of the upper and lower sections into a corresponding recess 58 in the other of the upper and lower sections to facilitate location. The two sections 50 and 52 may be snap fit, connected by adhesive or chemical or heat welding. Similarly, the transparent display cover 54 may be attached by a snap fit, adhesive, or by chemical or heat welding.

FIG. 5 also shows generally the components of the timing circuit 34. The timing circuit 34 is operatively connected to the reset switch switches 42 and 44 which extend through the main body at the inner rim and are biased toward the recess 28 by respective springs 60, so that the switches 42 and 44 may individually shift within the main body 12 when pressed by the user and may return to their original position when released. The switches 42 and 44, when actuated, permit electrical contact which completes a circuit to reset the timing functions in an integrated circuit 64 as described hereinafter. The timing circuit thus includes integrated circuit 64 as is well known in the art. The integrated circuit 64 is programmed so that upon receipt of current from a power source 66, such as a battery, a signal is provided to the display 32. The display 32 is positioned on third lobe 35C and includes a first digital indicator 67 and a second digital indicator 68, both of which are electronically connected to the integrated circuit 64. Each of the first and second digital indicators is electronically operated, and are preferably part of a liquid crystal display (LCD) 70, but could alternatively be provided as other types of digital displays such as light emitting diodes (LEDs). Each of the first and second digital indicators displays preferably two digits which correspond to date information to be presented to the user. That is, upon receipt of a signal from the integrated circuit, the first and second digital indicators display selected date information in the form of the number of days remaining in the useful life of the lens for the first digital indicator 67 and the remaining useful life of the receptacle for the lens for the second digital indicator 68. The programming of the integrated circuit 64 is preferably such that the range of numbers which may be displayed for the first digital indicator 67 is less than the range of numbers which may be displayed for the second digital indicator 68. For example, the range of numbers to be displayed by the first digital indicator 67, which provides a numeric display corresponding to the number of days remaining in the useful life of the lens, is between zero (00) and sixty (60), while the range of the numbers to be displayed by the second digital indicator 68, which provides a numeric display corresponding to the number of days remaining in the useful life of the receptacle 14 is between zero (00) and ninety-nine (99).

Figure 7:
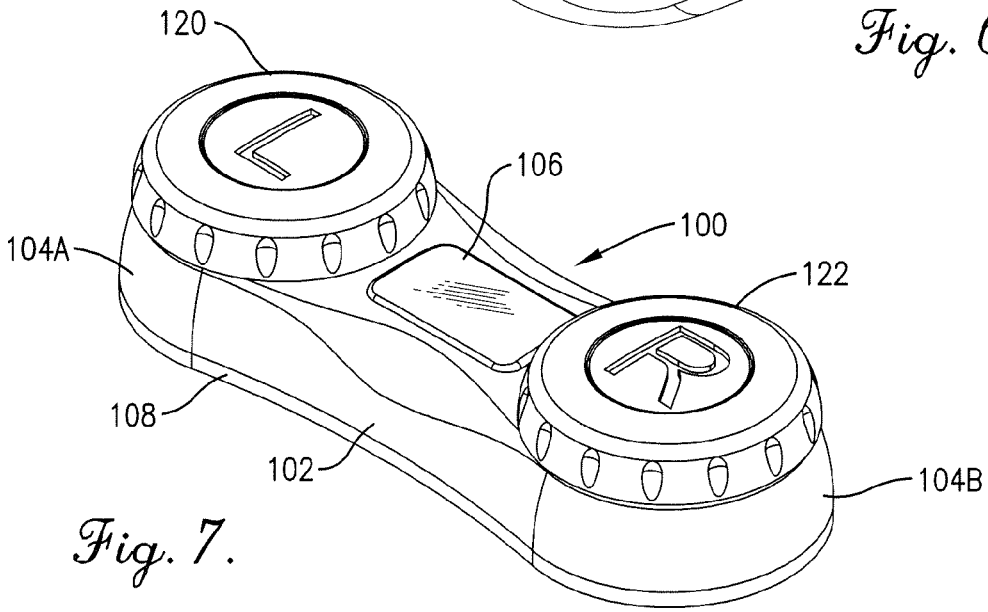
FIG. 7 is a top right front perspective view of a second embodiment of the contact lens case hereof, having a main body with a display positioned intermediate and along a line extending between chambers for the left and right contact lens of the wearer, and with a portion of the display cover broken away to show the display elements
Figure 9:
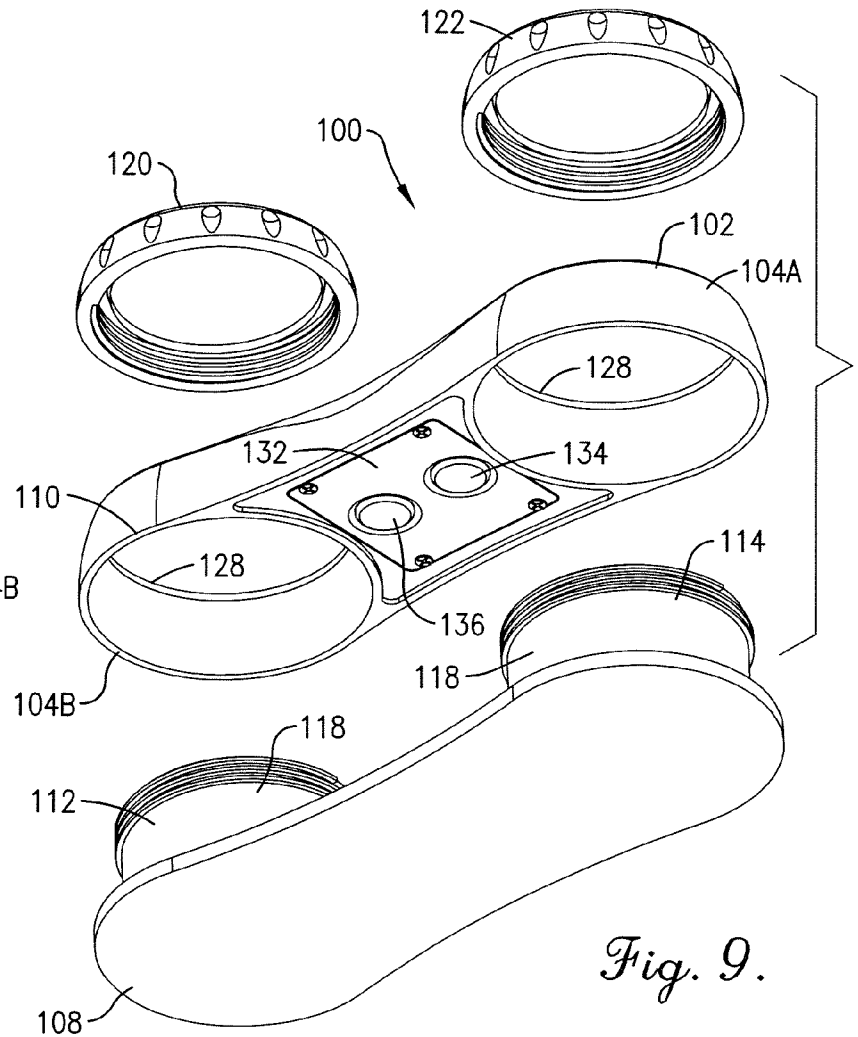
FIG. 9 is an exploded view from a bottom perspective, showing the positioning of the reset switches for the respective first and second countdown timing elements.
Figure 8:
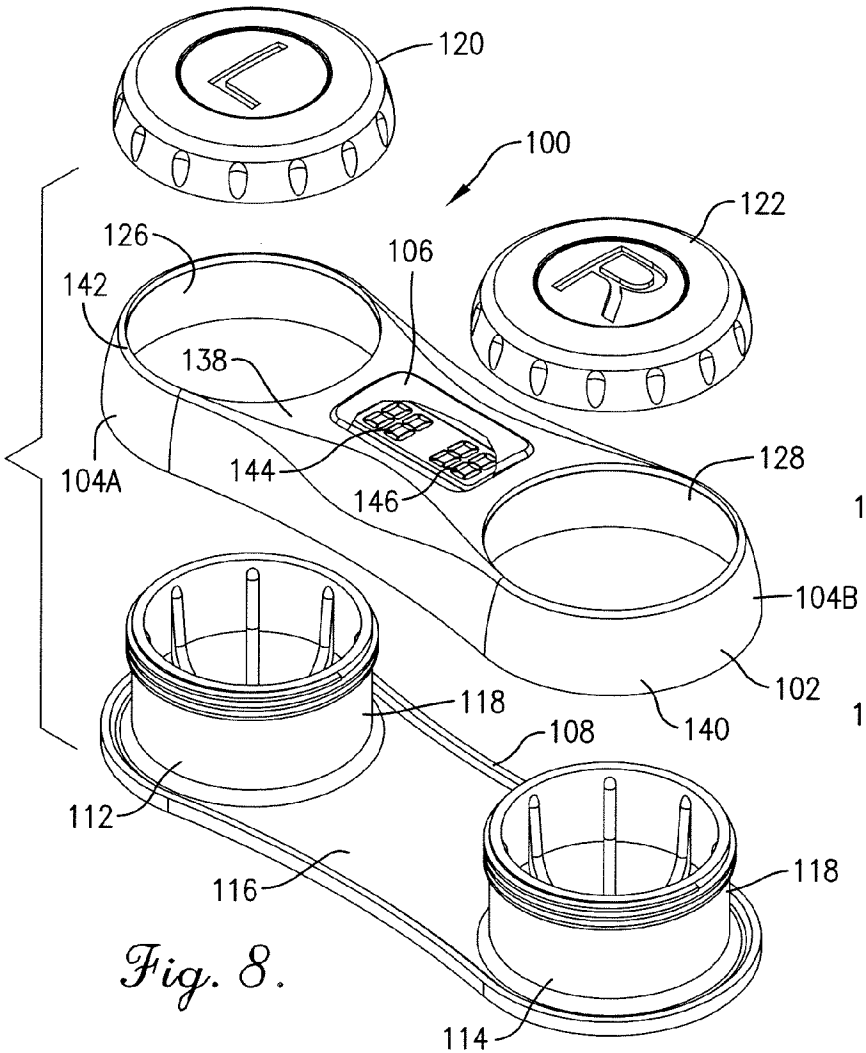
FIG. 8 is an exploded view thereof from a top front right perspective, showing a receptacle configured with chamber walls which extend up and through the main body such that the covers secure the main body to the receptacle.

FIGS. 7 through 9 illustrate a second embodiment of the countdown timer contact lens case 100, which includes a main body 102 oriented more linearly, i.e. with two lobes 104A and 104B having a digital display 106 positioned therebetween. The main body 102 detachably mounts a receptacle 108, which also serves to enclose the bottom edge 110 of the main body 102. The receptacle 108 includes two contact lens chambers 112 and 114 positioned in spaced relationship by a bridge 116. Each of the chambers 112 and 114 are provided with an outer wall 118 which is preferably generally cylindrical so that it may be threaded at the upper extent thereof to threadably receive caps 120 and 122. The diameter of the outer edge 124 of the caps is greater than the outside diameter of the outer wall 118 of the chambers 112 and 114. As may be seen in FIGS. 7 and 8, the main body is provided with openings 126 and 128 in each of the lobes 104A and 104B. The openings 126 and 128 are preferably generally circular, and of an inside diameter greater than the outside diameter of the outer wall 118 so as to permit passage of at least a part of the outer wall of each of the chambers 112 and 114 therethrough, yet smaller in diameter than the outer edge 124 the caps 120 and 122. Thus, with the caps 120 and 122 removed, the chambers 112 and 114 may pass through the respective openings 126 and 128, but upon attachment of the caps 120 and 122 thereafter, the receptacle 108 is held by the caps in position to enclose the bottom 130 of the main body 102.

The main body 102 also houses a countdown timing circuit 132, which is substantially similar to the timing circuit 30 of the first embodiment and includes the digital display 106, a power source such as a battery, and an integrated circuit. The timing circuit includes first reset switch 134 and second reset switch 136 which are positioned interiorly of the top surface 138 and the side surface 140 or outer rim 142 of the main body and thus protected against inadvertent actuation. The first and second reset switches 134 and 136 are spring biased to an outer position, so that pressing one of the switches actuates the integrated circuit to send a corresponding reset signal to the digital display 106. As in the case of the first embodiment, the digital display includes a first digital indicator 144 and a second digital indicator 146 which correspond respectively to the time remaining for use of the lens and for the time remaining for use of the receptacle.

The timing circuits 34 and 132 having internal clock functions and operate similarly, each including two separate and discrete timers controlled by the respective first and second reset switches and their value reflected in the corresponding first and second digital displays. In a preferred mode of operation, upon receiving a supply of electricity from the power source and pressing and holding the first reset switch for an initial period, for example 1 second, the first timer portion of the integrated circuit of the timing circuit will generate a signal to the first digital indicator to display a lens display maximum value, for example the number "60". If the first switch remains actuated, then for a second period the number displayed by the first digital indicator will decrement in value at a selected setting rate, for example one number per second. Thus, in this example, pressing or otherwise actuating the first reset switch for five seconds will result in an initial display of "60" and then continue decrementing at the setting rate of one number per second to "59", "58", "57", "56" and "55." If the first reset switch remains actuated after this second period, then preferably the rate at which the first digital indicator will decrement will increase to an increased setting rate of one number every ¾ of a second. In the preferred mode of operation, the integrated circuit is programmed such that if the first reset switch is released and then reactuated within the following three seconds, then the timing circuit returns to decrement the amount shown on the first digital indicator to the setting rate of one number per second for the first five seconds.

The timing circuit operates similarly for the second timer controlled by the second reset switch and shown on the second digital indicator in the same manner, with the exception that the number initially shown on the second digital indicator upon actuation of the second reset switch, which is the receptacle display maximum value, is "99" instead of "60."

After the respective first or second reset switch is released, then the timing circuit operates to decrease the value displayed on the respective first and second digital indicator at the rate of one number per day. The first decrement begins 24 hours after the respective reset switch is last released. The timing circuit operates independently with regard to timing for each of the reset switches and their corresponding digital indicators. Thus, the actuation of the second reset switch does not affect the number displayed on the first digital indicator, and in the same way actuation of the first reset switch does not affect the number displayed on the second digital indicator.

When the number displayed on the respective digital indicator reaches below a warning value, in the described example the number "05", that digital indicator will cycle or flash the number displayed at a 1 Hz rate, so that the number on the digital indicator is displayed for 0.5 seconds and the display is blank for the next 0.5 seconds, the cycle repeating unless the corresponding reset switch is actuated. If not reset by actuation of the corresponding reset switch, the value will continue to decrement at the rate of one number per day until reaching the number "00". Once the number displayed on the corresponding digital indicator reaches zero ("00"), the number "00" will continue to flash as above at a 1 Hz rate (0.5 seconds displayed, 0.5 seconds blank) until the user actuates the corresponding reset switch for more than one second to reset the internal timing and thus the corresponding digital indicator to its respective maximum value.

In the preferred embodiment, the integrated circuit is programmed to ignore actuation of the first and second switches for periods of less than one second. This facilitates avoiding unintended resetting of the displayed values. Any actuation of a reset switch for a period of greater than one second will cause the indicated value to initially flash or cycle at a 1 Hz rate as described above, to alert the user to the fact that the switch has been actuated and the reset operation initiated, and then reset to the maximum value for that timer ("60" for the first timer as displayed on the first digital indicator, and "99" for the second timer as displayed on the second digital indicator.)

Thus, each of the embodiments of the countdown contact lens case as described herein share some common benefits. That is to say, each provides separate timer functions and digital indicators for the lens and for the receptacle which holds the lens, it being contemplated that the receptacle will have a longer useful life before it should be replaced and thus a different range of displayed maximum dates for the first timer than the second timer. Each also includes reset switches which electronically reset the displays, but which are positioned remotely relative to the perimeter or outer surface of the main body to reduce unintended resetting of the switches. Each provides a main body which may have a relatively long useful life, and a detachable lens receptacle which can be removed from the main body without the need for tools and discarded independently of the main body.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

The invention claimed is:

1. A contact lens case for receiving and storing contact lenses, said contact lens case comprising:

a receptacle for receipt of said contact lenses;

a main body adapted for removably coupling with said receptacle, said main body including a power source and a timing circuit operatively coupled to said power source;

a digital display operatively coupled to said timing circuit for electrically receiving discrete first and second timing signals from the timing circuit and displaying date information corresponding to said first and second timing signals, said digital display including a first digital indicator for displaying lens date information corresponding to said first timing signal and a second digital indicator for displaying receptacle date information corresponding to said second timing signal;

a lens reset switch operatively coupled to said timing circuit and associated with said first timing signal; and a receptacle reset switch operatively coupled to said timing circuit and associated with said second timing signal, wherein said timing circuit is operative upon initial actuation of said lens reset switch to generate a lens reset signal setting said first digital indicator to a lens display maximum value, and after discontinued actuation of said lens reset switch to automatically and incrementally decrease the displayed lens date information at an operating rate corresponding to the passage of time to a value below said lens display maximum value, and wherein said timing circuit is operative upon initial actuation of said receptacle reset switch to generate a receptacle reset signal setting said second digital indicator to a receptacle display maximum value which is greater than said lens display maximum value and after discontinued actuation of said receptacle reset switch to automatically and incrementally decrease the displayed receptacle date information value at an operating rate corresponding to the passage of time to a value below said receptacle display maximum value.

2. A contact lens case according to claim 1, wherein said timing circuit is operative upon selected continued actuation of said lens reset switch after said initial actuation to generate a signal decreasing the displayed lens date information less than the lens display maximum value.

3. A contact lens case according to claim 2, wherein said timing circuit is operative upon selected continued actuation of said receptacle reset switch after said initial actuation to generate a signal decreasing the displayed receptacle date information less than the receptacle display maximum value.

4. A contact lens case as set forth in claim 1, said receptacle including— first and second lens-receiving chambers, and removable threaded caps threadably coupled to said lens-receiving chambers of the receptacle, wherein said main body includes structure defining a recess configured to removably carry said receptacle and to inhibit rotation of the receptacle during rotation of caps relative to receptacle chambers.

5. A contact lens case according to claim 4, wherein said main body presents a perimeter and an upper surface on which said digital display is mounted, and wherein said lens and receptacle reset switches are mounted on said main body to extend into said recess and are is positioned at least partially interiorly of said perimeter and said upper surface.

6. A contact lens case according to claim 1, said receptacle including first and second connected lens-receiving chambers, and wherein said main body includes first and second openings complementally configured to receive at least a portion of said chambers through at least one of said openings.

7. A contact lens case according to claim 6, wherein said lens-receiving chambers include— substantially cylindrical outer walls, and respective caps removably mountable to respective ones of said first and second chambers, wherein in a mounted condition, said caps serve to retain said receptacle in coupled relationship to said main body.

8. A contact lens case according to claim 1, said digital display including a substantially transparent cover coupled to said main body and extending over first and second digital indicators.

9. A contact lens case as set forth in claim 1, wherein said timing circuit is operable to decrement the displayed value of each of said first and second digital indicators at an operating rate of one number value per day upon release of the respective lens reset switch and receptacle reset switch.

10. A contact lens case as set forth in claim 9, wherein said timing circuit is operable to decrement the displayed value of the respective first and second digital indicators such that the decrement occurs at about 24 hours after the release of the respective lens reset switch and receptacle reset switch.

11. A contact lens case as set forth in claim 9, wherein said timing circuit is operable to decrement the displayed value of each of the first and second digital indicators at a setting rate in excess of one number per day during continued actuation of the corresponding reset switch for an extended setting period.

12. A contact lens case as set forth in claim 9, wherein the timing circuit is operable to provide a signal visible on the respective first or second digital indicator when the displayed lense date information value or the displayed receptacle date information value decreases below a selected warning level value.

13. A contact lens case for receiving and storing contact lenses, said contact lens case comprising:

a housing associated with a receptacle for receipt of said contact lenses, said housing including a timing circuit:

a display operatively coupled to said timing circuit for electrically receiving discrete first and second timing signals from the timing circuit and displaying date information corresponding to said first and second timing signals, said display including a first indicator for displaying lens date information corresponding to said first timing signal, and a second indicator for displaying receptacle date information corresponding to said second timing signal:

a lens reset switch operatively coupled to said timing circuit and associated with said first timing signal; and a receptacle reset switch operatively coupled to said timing circuit and associated with said second timing signal, wherein said timing circuit is operative upon initial actuation of said lens reset switch to generate a lens reset signal setting said first indicator to a lens display maximum value, and after discontinued actuation of said lens reset switch, to automatically and incrementally decrease the displayed lens date information at an operating rate corresponding to the passage of time to a value below said lens display maximum value, and wherein said timing circuit is operative upon initial actuation of said receptacle reset switch to generate a receptacle reset signal setting said second indicator to a receptacle display maximum value which is greater than said lens display maximum value, and after discontinued actuation of said receptacle reset switch, to automatically and incrementally decrease the displayed receptacle date information value at an operating rate corresponding to the passage of time to a value below said receptacle display maximum value.

14. A method for storing contact lenses in a contact lens case, the method comprising the steps of:

obtaining the contact lens case for storage of the contact lenses, the contact lens case including— a housing associated with a receptacle for receipt of said contact lenses, said housing including a timing circuit, a display operatively coupled to said timing circuit for electrically receiving discrete first and second timing signals from the timing circuit and displaying date information corresponding to said first and second timing signals, said display including a first indicator for displaying lens date information corresponding to said first timing signal, and a second indicator for displaying receptacle date information corresponding to said second timing signal, a lens reset switch operatively coupled to said timing circuit and associated with said first timing signal, and a receptacle reset switch operatively coupled to said timing circuit and associated with said second timing signal;

actuating the lens reset switch so as to set the lens date information to a maximum value corresponding to a maximum time for wear of the contact lenses; and actuating the receptacle reset switch so as to set the receptacle date information to a maximum value corresponding to a maximum time for use of the receptacle, wherein the maximum value for the lens date information is different than the maximum value for the receptacle date information.

15. The method as set forth in claim 14, further including the step of decrementing the displayed value of each of said first and second indicators at a predetermined operating rate upon release of the respective lens reset switch and receptacle reset switch.

* * * * *